US006199719B1

(12) United States Patent
Bordage

(10) Patent No.: US 6,199,719 B1
(45) Date of Patent: Mar. 13, 2001

(54) PORTABLE CONTAINER AND METHOD OF MAKING PORTABLE CONTAINER

(75) Inventor: Jacques Bordage, Key West, FL (US)

(73) Assignee: Key West Fragrance & Cosmetic Factory, Inc., Key West, FL (US)

( * ) Notice: Subject to any disclaimer, the term of this patent is extended or adjusted under 35 U.S.C. 154(b) by 0 days.

(21) Appl. No.: 09/434,445

(22) Filed: Nov. 5, 1999

(51) Int. Cl.[7] ..... B65D 25/28

(52) U.S. Cl. ..... 220/754; 220/756; 220/770; 215/399

(58) Field of Search ..... 220/756, 754, 220/752, 751, 770, 759; 215/399, 398, 396; 224/257, 148.7, 148.5

(56) References Cited

U.S. PATENT DOCUMENTS

| | | | | |
|---|---|---|---|---|
| 610,425 | * | 9/1898 | Abbott | 220/770 |
| 674,489 | * | 5/1901 | Wall | 220/770 |
| 735,554 | * | 8/1903 | Miller | 220/770 |
| 3,630,251 | * | 12/1971 | Ross | 220/751 |
| 4,228,758 | * | 10/1980 | Dornau et al. | 114/219 |
| 4,252,073 | * | 2/1981 | Hartung et al. | 114/219 |
| 4,744,461 | * | 5/1988 | Lapham | 206/5 |
| 5,244,135 | * | 9/1993 | Nelson | 224/604 |
| 5,427,259 | * | 6/1995 | Krastanov | 215/11.1 |

* cited by examiner

*Primary Examiner*—Stephen Castellano
(74) *Attorney, Agent, or Firm*—Burns, Doane, Swecker & Mathis, L.L.P.

(57) ABSTRACT

A portable container includes a closed volume defined by at least one wall member, a through hole extending through the at least one wall member at at least two points, an interior of the through hole being separated from the volume, and a cord extending through the through hole to form a handle. A method of making a portable container is also disclosed.

5 Claims, 2 Drawing Sheets

PORTABLE CONTAINER AND METHOD OF MAKING PORTABLE CONTAINER

FIELD OF THE INVENTION

The present invention relates to containers and, more particularly, to containers having handles.

BACKGROUND AND SUMMARY OF THE INVENTION

It is known to provide hooks and hangers on containers for substances such as shampoo and conditioner to facilitate hanging these containers from articles such as shower heads. This arrangement is convenient in that the limited space usually available in a bath or shower stall need not be cluttered with all manner of containers. Such hook or hanger arrangements, however, generally call for a relatively complex container manufacturing process whereby the hook or hanger is attached to the container after manufacture of the container or is formed integrally with the container. In addition, the hook or hanger is generally limited in dimension such that the hook or hanger can be hung over only relatively small diameter objects. It is desirable to provide a simple to manufacture structure, as well as a structure that can be hung over objects having a variety of shapes and sizes.

It is also known to provide so-called "soap on a rope" by, for example, embedding a rope or cord in the material forming a bar of soap as the soap material solidifies. This arrangement is particularly convenient in those situations in which it is necessary to convey a bar of soap to a bathing site, such as during camping trips or in barracks- or dormitory-style accommodations. While this arrangement permits hanging the soap over objects in a variety of shapes and sizes, such as around a user's neck or wrist or over faucets and handles, it is only suited for those materials, such as hard soap, that do not require an external container. It is desirable to provide an arrangement that permits easily transporting containers for liquid, granular, or powder materials.

In accordance with one aspect of the present invention, a portable container includes a closed volume defined by at least one wall member, a through hole extending through the at least one wall member at at least two points, an interior of the through hole being separated from the volume, and a cord extending through the through hole to form a handle.

In accordance with another aspect of the present invention, a method of making a portable container is provided. According to the method, at least two holes are formed in a wall of a tube. The tube is compressed so that portions of the wall in which the at least two holes are formed are adjacent and the at least two holes are aligned. The at least two holes are fixed relative to each other so that the two holes define a through hole through the tube. A cord is extended through the through hole to form a handle.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
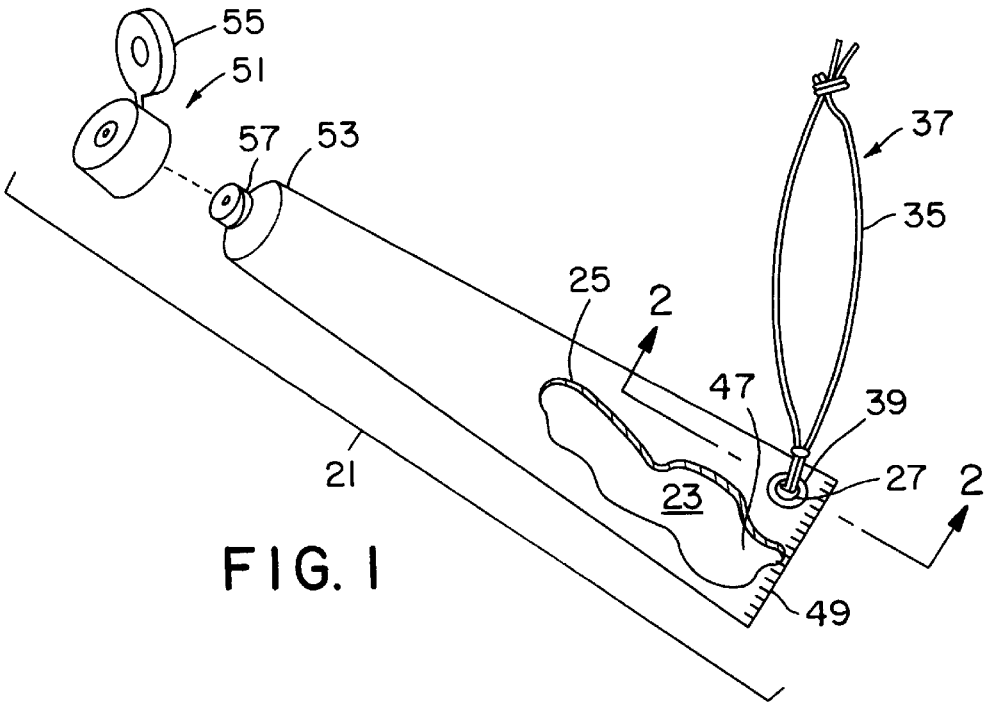
FIG. 1 is a perspective, partially broken, exploded view of a container according to an embodiment of the present invention.
Figure 2:
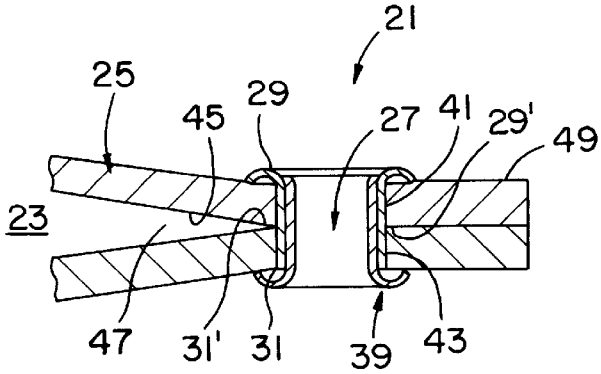
FIG. 2 is a cross-sectional view of the container of FIG. 1 taken at section 2—2.

A portable container 21 according to an embodiment of the present invention is shown FIGS. 1 and 2. The container 21 includes a closed volume 23 defined by at least one wall member 25. A through hole 27 extends through the at least one wall member 25 at at least two points 29 and 31. An interior of the through hole 27 is separated from the volume. A cord 35 extends through the through hole 27 to form a handle 37.

The through hole 27 is preferably formed by a grommet 39 secured in holes 41 and 43 formed in at least one wall member 25 at the at least two points 29 and 31. The use of a grommet 39 to define the through hole 27 is particularly advantageous because the grommet can be installed at a number of different points along a manufacturing line, or can be installed manually, and the holes 29 and 31 can be formed at a number of different points along the manufacturing line, or formed manually. In short, use of the grommet 39 does not require specially adapting container manufacturing equipment to provide the through hole. Thus, containers can be made according to conventional techniques, shipped, and then provided with a grommet. Moreover, the grommet 39 can provide a very strong supporting structure for the handle 37.

Preferably, the closed volume 23 is defined in part by a single, substantially tubular side wall 25, and the tube is compressed at the two points 29 and 31 so that portions 29' and 31' of an interior surface 45 of the wall at the two points are in contact with each other and the holes 41 and 43 define a continuous hole. If desired or necessary, however, the holes 41 and 43 may be separated from each other by a distance and walls of the grommet 39 may separate the interior of the through hole 27 from the interior volume 23. It is necessary that the interior of the through hole 27 be separated from the interior volume 23 so that contents of the container 21 do not inadvertently escape through the through hole.

A container 21' showing one alternative to forming the through hole 27 with a grommet is to seal portions 29' and 31' of the interior surface 45 of the wall 25 to each other, such as with an adhesive or by application of heat and/or pressure, depending upon the material from which the wall 25 is formed, and form the through hole 27 by punching through the sealed portion of the wall. The seal 39' surrounding the through hole 27 serves to prevent contents in the interior volume 23 from escaping through the through hole.

It will be appreciated that various other structures, such as tubes, can be inserted through holes at the two points 29 and 31 to form the through hole 27 and material forming the wall 25 can be sealed around the structures to prevent escape of contents of the container from the volume 23. It will further be appreciated that the present invention is not limited to application with structures such as flexible tubular containers and may be adapted for use with containers having one or more rigid or substantially rigid walls.

In the preferred embodiment of the container 21 shown in FIGS. 1 and 2, an end 47 of the closed volume 23 is defined by a sealed end 49 of the tubular side wall. The sealed end 49 may be formed in any suitable manner, such as by heat and/or pressure sealing or an adhesive. Further, the sealed end 49 may be provided with a removable cap assembly 51. Preferably, both ends 49 and 53 of the container 21 are sealed. The first end 49 is preferably sealed by bonding the interior surface 45 of the wall 25 to itself, such as with a heat and/or pressure bond and/or with adhesive, and the second end 53 is preferably sealed with a removable cap assembly 51. The removable cap assembly 51 is preferably of the type conventionally used with toothpaste, lotion, and other tubular containers, and may include a further hinged lid portion 55 that is, for example, attached to the second end 53 by a threaded connection 57.

The container 21 is preferably formed of a plastic material or a metallic material, but any material suitable for the contents of the container may be used. Likewise, the removable cap assembly 51 is preferably a suitable plastic or metallic material. The cord 35 is preferably any suitable material, such as nylon, and may be extended through the through hole 27 and have its ends tied to form a loop. The container 21 according to the present invention is particularly useful as a container for materials such as suntan lotion which would otherwise have to be carried to a point of use in a user's hand or in a separate container. The present invention provides the convenience of permitting the container to be held by the user without occupying the user's hands, which can be used to perform other activities, and without taking up space in a separate container. Further, the present invention permits the container 21 to be suspended from any number of objects having a variety of shapes and sizes.

Figure 4:
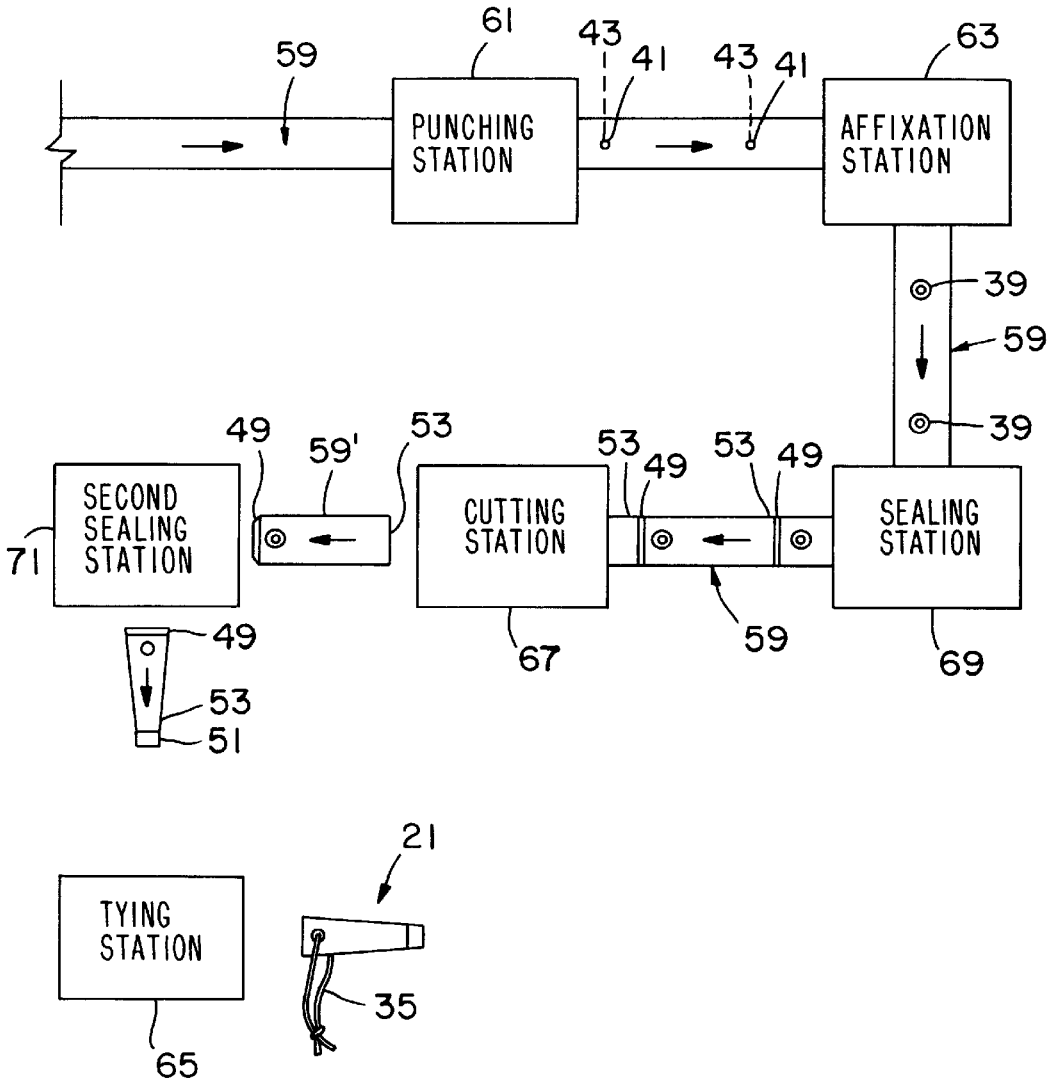
FIG. 4 is a schematic view of a method of making a container according to an embodiment of the present invention.

A method of making a portable container 21 according to an embodiment of the present invention is described in connection with FIG. 4. According to the method, at least two holes 41 and 43 are formed in a wall 25 of a continuous tube 59 at, for example, a punching station 61. Preferably, the tube 59 is initially compressed so that portions 29' and 31' of the wall 25 in which the at least two holes 41 and 43 are to be formed are adjacent prior to forming the holes. If desired or necessary, such as where the tube 59 is not flexible or has limited flexibility, the portions 29' and 31' in which the holes 41 and 43 are formed may be separated from each other.

In any event, the at least two holes 41 and 43 are aligned. The at least two holes 41 and 43 are, after alignment, fixed relative to each other so that the two holes define a through hole 27 through the tube 59 at, for example, an affixation station 63. A cord 35 is extended through the through hole 27 to form a handle 37 at some point after forming the through hole, such as at a tying station 65.

Before or after separating the continuous tube 59 into a plurality of discrete tubes 59' at, for example, a cutting station 67, the first end 49 and the second end 53 of what is or will become the tube 59' are sealed at, for example, a sealing station 69. The first end 49 of the tube 59 is preferably sealed by bonding an interior surface 45 of the wall 25 to itself, such as through application of heat and/or pressure and/or through use of an adhesive. The second end 53 of the tube 59 is preferably sealed by attaching an openable and closable cap assembly 51 to the tube 59 at, for example, a second sealing station 71.

Figure 3:
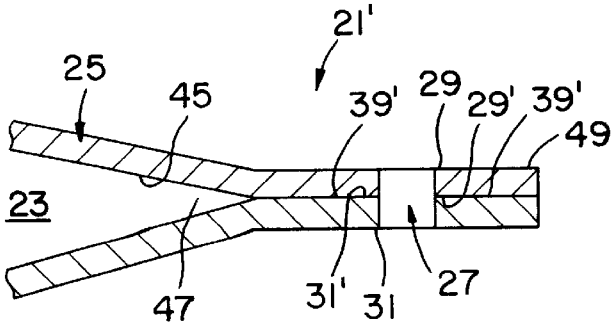
FIG. 3 is a cross-sectional view of a container according to another embodiment of the present invention.

The two holes 41 and 43 are preferably fixed relative to each other by securing the holes in position with a grommet 39. Alternatively, as in the embodiment of FIG. 3, or in addition to securing with a grommet 39, the two holes 41 and 43 may be fixed relative to each other by securing the holes in position with a heat seal or an adhesive that bonds the interior surface 45 of the wall 25 of the tube to itself. The holes 41 and 43 may be formed in the tube before or after bonding of the interior surface 45 of the wall 25 of the tube to itself.

It will be appreciated that the exact sequence in which the various operations involved in making the container 21 are performed is generally speaking, not crucial, except to the extent that certain operations, such as extending the cord 35 through the through hole 27, must be performed after other operations, such as forming the through hole 27 in the first place. Obviously, the holes 41 and 43 need only be punched in the tube 59 before the holes are affixed relative to one another if the affixation is accomplished by means of, for example, a grommet 39. Otherwise, the affixation step may be performed simultaneously with forming of the holes, such as where the holes are formed simultaneously with bonding of the interior wall of the tube is bonded to itself, or the interior wall of the tube may be bonded to itself before forming the holes. The presently preferred sequence of operations is that a tube 59 is filled with contents and sealed to provide the sealed end 49 and the cap 51 at the second end 53. Then the holes 41 and 43 are formed and the grommet 39 installed. Finally, the cord 35 is attached.

While this invention has been illustrated and described in accordance with a preferred embodiment, it is recognized that variations and changes may be made therein without departing from the invention as set forth in the claims.

What is claimed is:

1. A portable container, comprising:

a closed volume defined by at least one wall member;

a through hole extending through the at least one wall member at at least two points, an interior of the through hole being separated from the volume; and a cord extending through the through hole to form a handle, wherein the through hole is formed by a grommet secured in holes formed in at least one wall member at the at least two points.

2. The portable container as set forth in claim 1, wherein the closed volume is defined in part by a single, substantially tubular side wall.

3. The portable container as set forth in claim 2, wherein an end of the closed volume is defined by a sealed end of the tubular side wall.

4. The portable container as set forth in claim 3, wherein an end of the closed volume is defined by a removable cap.

5. The portable container as set forth in claim 2, wherein an end of the closed volume is defined by a removable cap.

* * * * *